US007464651B2

(12) United States Patent
Brandt

(10) Patent No.: US 7,464,651 B2
(45) Date of Patent: Dec. 16, 2008

(54) BOGEY FRAME SENSOR FOR RAILCAR MOVER

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 278 days.

(21) Appl. No.: 11/413,764

(22) Filed: Apr. 27, 2006

(65) Prior Publication Data

US 2007/0251406 A1 Nov. 1, 2007

(51) Int. Cl.
*B61B 1/00* (2006.01)
*B61B 13/00* (2006.01)

(52) U.S. Cl. ..... 104/162

(58) Field of Classification Search ..... 104/162, 104/172.5, 27
See application file for complete search history.

(56) References Cited

U.S. PATENT DOCUMENTS 3,522,772 A * 8/1970 Hunt ..... 104/162
4,354,792 A * 10/1982 Cornish ..... 414/359
5,588,368 A * 12/1996 Richter et al. ..... 105/199.1
5,709,153 A * 1/1998 Brandt ..... 104/162
6,267,059 B1 * 7/2001 Brandt ..... 104/162
6,389,984 B2 * 5/2002 Brandt ..... 104/162
6,668,730 B2 * 12/2003 Goldbeck ..... 104/162
6,837,168 B1 * 1/2005 Goldbeck et al. ..... 104/162
7,051,660 B2 * 5/2006 Insana et al. ..... 104/162
2002/0007760 A1 * 1/2002 Brandt ..... 104/182
2003/0136295 A1 * 7/2003 Goldbeck ..... 104/96
2005/0005810 A1 * 1/2005 Goldbeck et al. ..... 104/162
2007/0251406 A1 * 11/2007 Brandt ..... 104/27

* cited by examiner

*Primary Examiner*—Mark Le
*Assistant Examiner*—Jason C Smith
(74) *Attorney, Agent, or Firm*—Nikolai & Mersereau, PA; C. G. Mersereau

(57) ABSTRACT

A railcar moving or positioning system incorporating relatively simple mechanical bogey frame side member sensing systems mounted on each dog carriage of a railcar indexing system is disclosed. Each sensing system is used to control the operation of a dog mounted on the same carriage. A mechanical follower device is employed to sense the underside of an encountered bogey frame side member. Deflection of the follower is used to operate a hydraulic valve which, in turn, is used as a control cylinder to raise or lower an adjacent dog member.

6 Claims, 7 Drawing Sheets

BOGEY FRAME SENSOR FOR RAILCAR MOVER

BACKGROUND OF THE INVENTION

I. Field of the Invention

The present invention relates generally to trackside railway car handling equipment for positioning railway cars along a track for loading or unloading operations. More particularly, the present invention relates to train indexer systems that include dogs that engage the bogey frames of railcars and, specifically, to indexer systems that include mechanical systems for sensing the presence of bogey frames in conjunction with the operation of the dogs.

II. Related Art

Freight-hauling railway cars need to be precisely positioned proximate freight or cargo handling equipment during loading and unloading operations. Freight in the form of bulk cargo such as grain is typically loaded or unloaded with reference to stationary freight handling equipment such as chutes and conveyor equipment situated at fixed locations above or in pits beneath a specific portion of the track. Railcars for transporting grain or other such finely divided dry bulk agricultural commodities may be covered and designed with a plurality of spaced bottom discharge hopper bins or chutes accessing the main cargo storage volume. The chutes are closed by capstan-operated rack and pinion bottom closure gate systems.

In the loading and discharge operations, a connected engine roughly positions one end of a string of cars to be loaded or unloaded beneath or above the appropriate equipment at the desired fixed location. Because locomotives are not well suited for precisely positioning individual cars or even strings of cars along a railroad track, positioning devices known as train movers or positioners are located at fixed stations along the track. The positioning devices are generally in the form of "indexers", or "progressors". Indexers generally employ a pair of spaced "dogs", which operate together. The dogs are heavy car-engaging members mounted on movable dog carriages which are operated along built-in auxiliary carriage tracks or guideways. In the case of systems designed to operate by pushing against railway car truck bogey frames, the guideways are located one on the outside of each of the track rails in juxtaposed parallel relation thereto to engage and simultaneously push against the spaced sides of a bogey frame, axle or other portion of a railcar to urge the car and others attached to it in a desired direction for a limited distance. The system then retracts and finds the next bogey frame or axle, etc. to repeat the process. The system can be stopped at any point in a cycle when the desired position is reached for loading or unloading a car.

Progressors designed to operate against bogey frames also have built-in guideways on the outside of each of the spaced rails with dogs that operate along each of the guideways. The systems are also spaced along the track and, rather than operating simultaneously against both sides of a bogey frame to move a car or string of cars, the dogs of a progressor are operated alternately, sequentially to "hand off" the car or string of cars alternating between dogs on opposed sides of the track.

Using either type system an entire string of connected cars may be advanced and loaded or unloaded, one car at a time. As with the indexer system, the progressor can be stopped at any point in the operating cycle when the desired position is reached.

The positioning devices of the present invention are indexer systems that utilize dogs that operate against the wheel truck bogey frames of the cars. The proper operation of these devices depends on the ability of the system to detect the presence of bogey frames and operate corresponding dogs accordingly. Many techniques have been employed to detect the presence of or locate wheel truck bogey frames. These include optical or mechanical devices that sense the presence of train wheels, mechanical devices that are linked to operate the dogs directly upon detection of the presence of a wheel truck bogey frame, techniques that include using the deflection of raised dogs striking carriage bogey frames from behind to sense those frames. Using the "dog" method, the first of two spaced opposed dogs encountering the bogey frame is pushed down from behind and the second dog which is also in the pushing posture engages the bogey frame as the dog carriage continues to move.

While such systems work quite well, the presence of auxiliary devices such as tripper rods which are used in conjunction with operating bottom discharge gates may interfere with using raised dogs as sensors. Direct connected mechanical systems are shown, for example, in U.S. Pat. Nos. 6,389,984 and 5,709,153. These also require additional mechanical linking devices. Thus, there remains a need to provide a simple mechanical truck carriage bogey frame detecting system that includes a simplified operating system for a corresponding pusher dog.

SUMMARY OF THE INVENTION

In accordance with the present invention there is provided a railcar indexing system incorporating a relatively simple mechanical bogey frame sensing system that is mounted on each dog carriage of the indexing system and used to control the operation of a corresponding dog mounted on the same carriage. The sensing system includes a mechanical follower device mounted on a crank arm positioned to be deflected by the underside of an encountered bogey frame. The crank arm is linked through a series of devices which operate to open a normally closed hydraulic valve device which, in turn, enables a connected cylinder to raise or lower a corresponding dog member.

The detailed embodiment illustrates a high dog railcar indexing system that includes right and left indexers, each of which is provided with a mechanical bogey frame detecting system in accordance with the present invention. The railcar indexing system includes a pair of trackside guideways located along, just outside of and parallel to the rails of the track. A dog carriage is mounted in and designed to operate along each such trackside guideway. A vertically pivoted pusher dog is mounted on each carriage. A bogey frame sensing system is mounted on each carriage associated with and used in the control of the operation of the corresponding pusher dog.

As indicated, each bogey frame detecting system includes a crank arm-mounted follower wheel designed to encounter and be deflected by the underside of a bogey frame. The crank arm is connected through a series of devices to an operating lever that provides a force to overcome a spring and open a spring-biased, normally closed hydraulic valve device which, in turn, is connected in a line to a cylinder for operating a corresponding pusher dog. The valve is mounted in relation to and designed to be opened according to the deflection of the follower. A resilient or spring-biased linkage is provided to enable the follower to operate the spring-biased valve. The linkage includes a pair of springs mounted on a movable rod connected to move through an opening in a deflection plate such that one spring is located and maintained on either side of the deflection plate. The deflection plate is, in turn, connected to bias and flex a switch-operating resilient member.

The follower crank arm is fixed to and designed to rotate a shaft member in a first direction when it is in a bogey frame seeking mode. The shaft member, in turn, operates a connected pusher member, which is also connected to a fixed end of the movable rod carrying the springs and which operates in the detecting mode to force the movable rod to move in a first direction generally parallel to its length compressing a near spring against the deflection plate and releasing a spring beyond the deflection plate. This flexes a valve opening member against a valve-operating pushbutton eventually producing sufficient force to overcome an internal valve spring. This opens the normally closed spring-biased hydraulic valve. The valve is located in a line connected to a dog-operating cylinder and when the valve is opened, this causes the cylinder to retract and raise the dog. Conversely, when the follower is released, the shaft is rotated in the opposite direction, the rod is retracted and the spring beyond the deflection plate is compressed and the spring closer to the pusher is released. A return or counter-balance spring may also be provided to counter-balance the system and aid return of the flexed switch-operating member and closing of the valve.

After the right and left indexers both find corresponding bogey frame side members and have their dogs raised, both indexers are operated to push together to move the car or string of cars along the track using several serially connected hydraulic cylinders or other means. When it is desired to retract the indexers, as at the end of a stroke or to position the next car, retraction of the indexers causes the followers to move out from under the bogey frame holding them down and this allows the followers to pop up and the corresponding spring-biased hydraulic valve to close as described. This leads to a lowering of the dogs and passage of the follower under a bogey frame side member in the opposite direction does not affect the spring-biased valve.

A system is also provided to lock down the followers in a non-detecting mode and maintain the dogs in a down position when the indexer is fully retracted.

BRIEF DESCRIPTION OF THE DRAWINGS

In the drawings wherein like reference characters are used to designate like parts throughout the same.

DETAILED DESCRIPTION

The following detailed description of the present invention describes the invention with reference to railcar indexing system employing a pair of spaced pusher dogs that operate in unison against opposite sides of a bogey frame. The carriages then retract and the dogs drop or are pushed down until the followers find the next wheel truck bogey frame and the process is the repeated. The system may be stopped anywhere the operator desires so that loading or unloading operations may be performed. It will be appreciated that the system described is intended to be an example of the inventive concept and is not to be considered as a limitation on the scope of the invention.

Figure 1A:
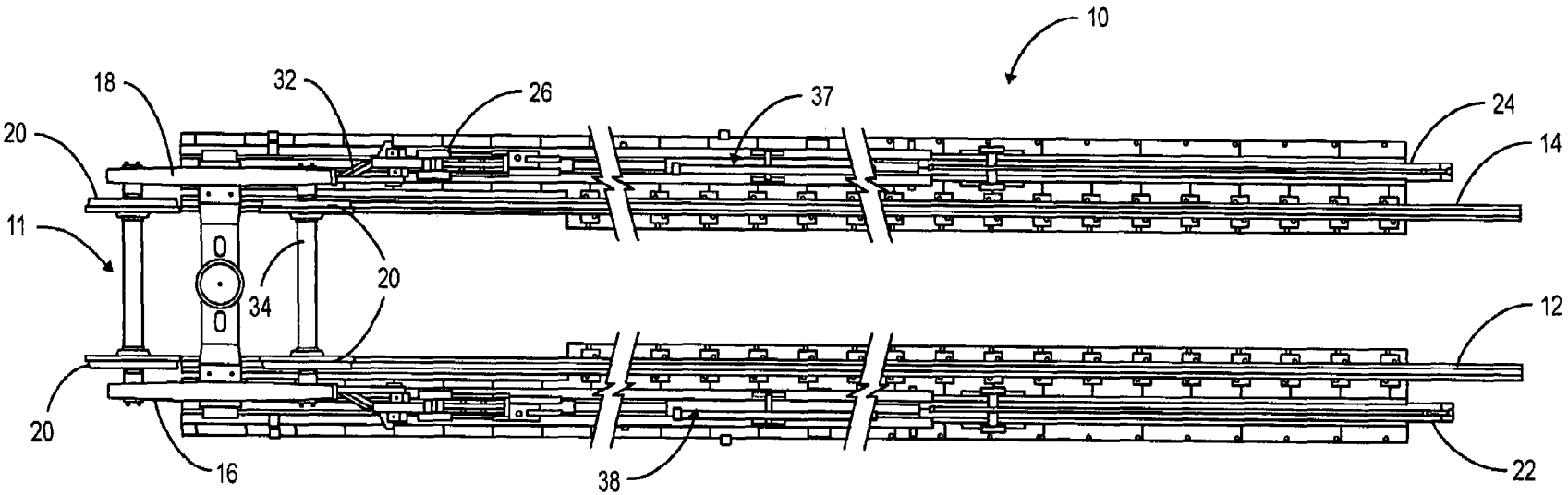
FIG. 1*a* is a broken plan view of a high dog railcar indexer system using bogey frame sensing in accordance with the invention shown with a single railcar wheel truck assembly.
Figure 1B:
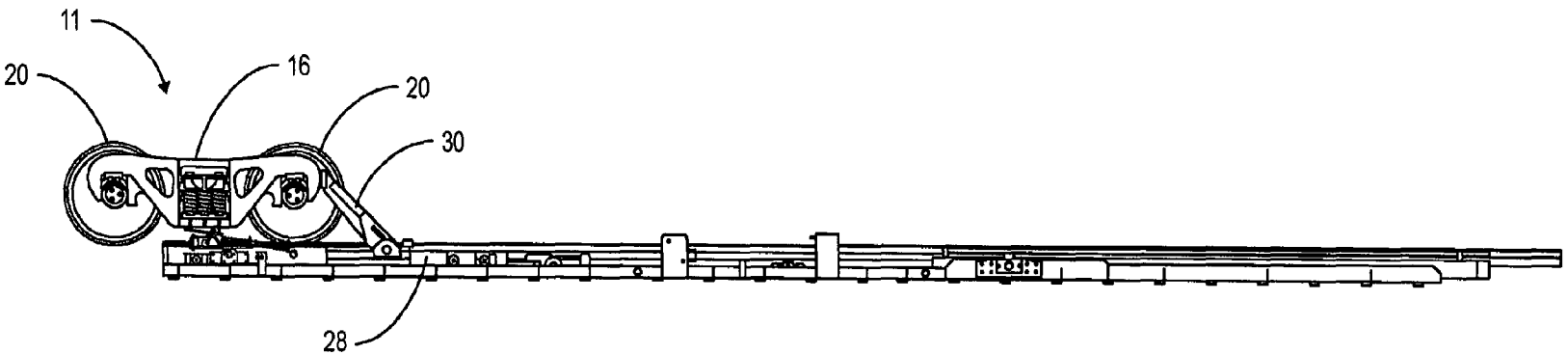
FIG. 1*b* is a side elevational view of the railcar indexer system of FIG. 1*a;*

FIGS. 1*a* and 1*b* are fragmentary plan and side views that depict a high dog railcar indexer, generally at 10, including a railcar wheel truck assembly 11 situated on a railroad track having rails 12 and 14, the truck assembly having spaced bogey frame side members 16 and 18, respectively, which extend beyond the spaced rails. The truck carriage further includes four wheels as at 20. A pair of spaced trackside guideways are shown at 22 and 24 situated just outside and extending along parallel to the track rails 12 and 14, together with a pair of dog carriages 26 and 28, respectively, carrying high pusher dogs 30 and 32, best seen in FIG. 2, which are shown in the raised position addressing the spaced bogey frame sides 16 and 18, respectively, contacting them above the level of an axle 34. A bogey frame sensing system in accordance with the invention is shown generally 36 in FIGS. 2 and 3 and the system at 36 being used to control dog 32. The dog carriages 26 and 28 are operated by reciprocating, serially connected or tandem hydraulic cylinder devices, generally, 37 and 38 (FIG. 1), which may consist of four cylinders, and operate in series to move the carriages along the corresponding guideways. The bogey frame detecting and dog-operating system of the invention is shown in greater detail in FIGS. 3-7.

Figure 2:
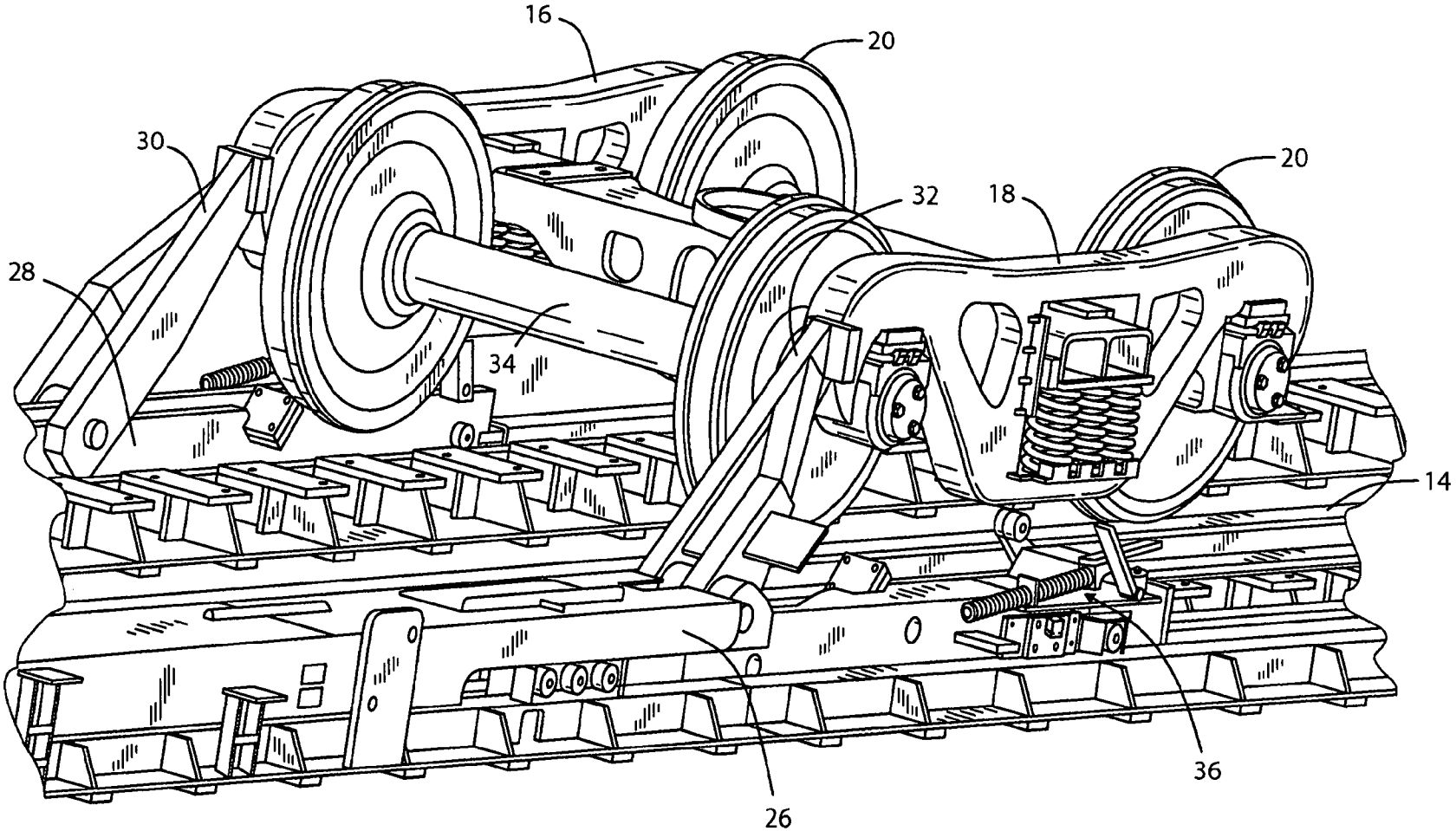
FIG. 2 is an enlarged fragmentary perspective view of a railcar indexing system similar to that illustrated in FIGS. 1*a* and 1*b;*
Figure 3:
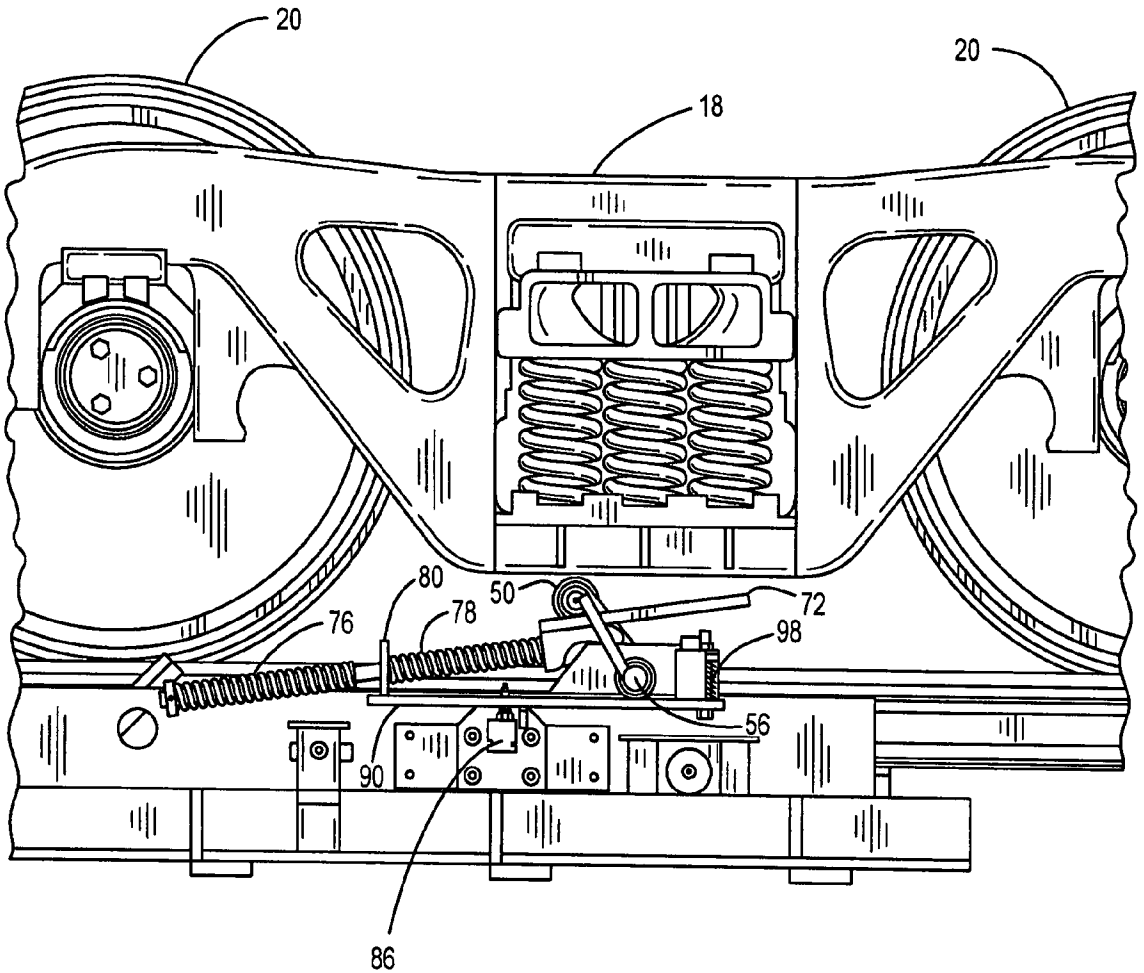
FIG. 3 is a greatly enlarged fragmentary side view of a portion of the system of FIG. 2.

FIG. 3 is a greatly enlarged fragmentary side view of a portion of the railway indexing system of FIG. 2 showing bogey frame side member 18 having an underside 40 with which the bogey frame detecting system of the invention interacts. Although only a single bogey frame detecting system will be described, it will be noted, as seen in FIG. 1, that identical opposed systems are employed in left and right indexers adjacent the spaced rails of the track. The details of bogey frame detecting and dog operating system 36 will next be described in greater detail.

An important aspect of the system is a system designed to mechanically detect the presence and passage of the underside of a railcar wheel truck bogey frame side member rather than detecting the passage of a wheel or other portion of the car. The system is also one used to control raising and lowering of a corresponding dog based on the operation of the bogey frame detection system of the invention. The detection system utilizes a spring-biased lever-operated concept to flex a resilient member which, in turn, depresses a valve opening pushbutton during the interval that a follower is held down under the underside of a bogey frame side member, thereby opening a normally closed hydraulic valve which, in turn, causes a hydraulic cylinder to raise a corresponding dog.

Figure 4:
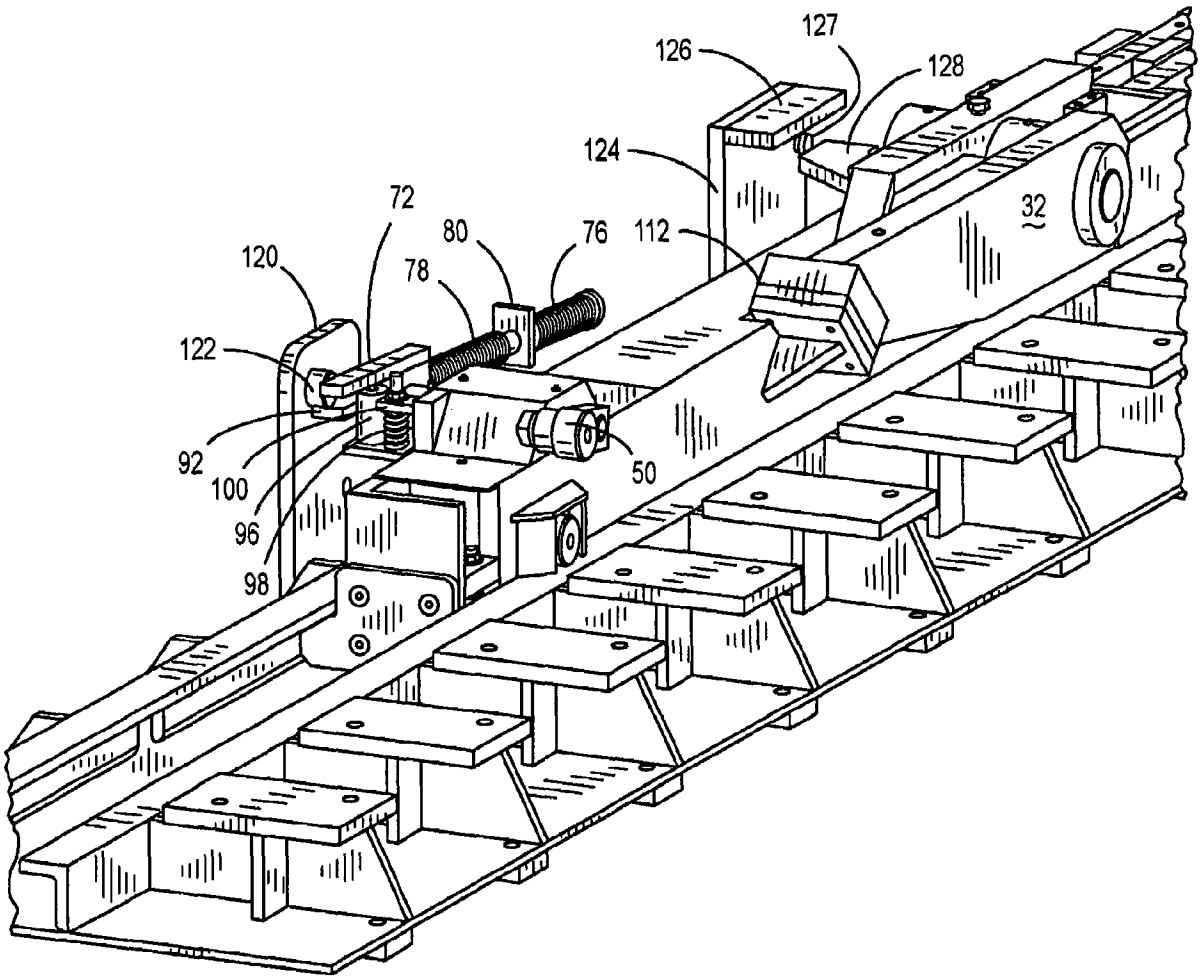
FIG. 4 is an inside fragmentary perspective view of an indexer of the indexing system of FIG. 2.
Figure 5:
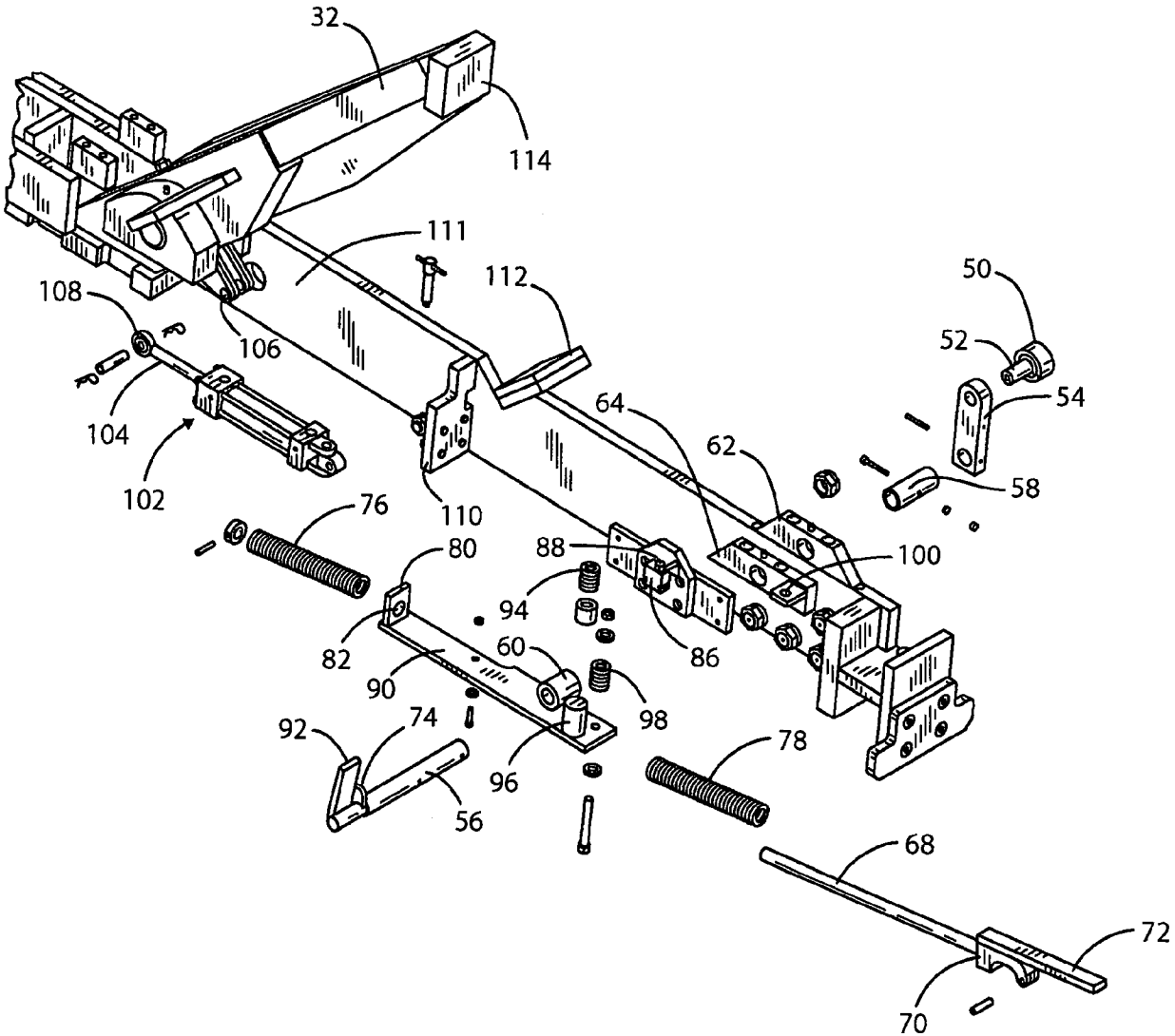
FIG. 5 is an exploded perspective view of a bogey frame detecting and dog operating system in accordance with the invention with parts removed for clarity.
Figure 6:
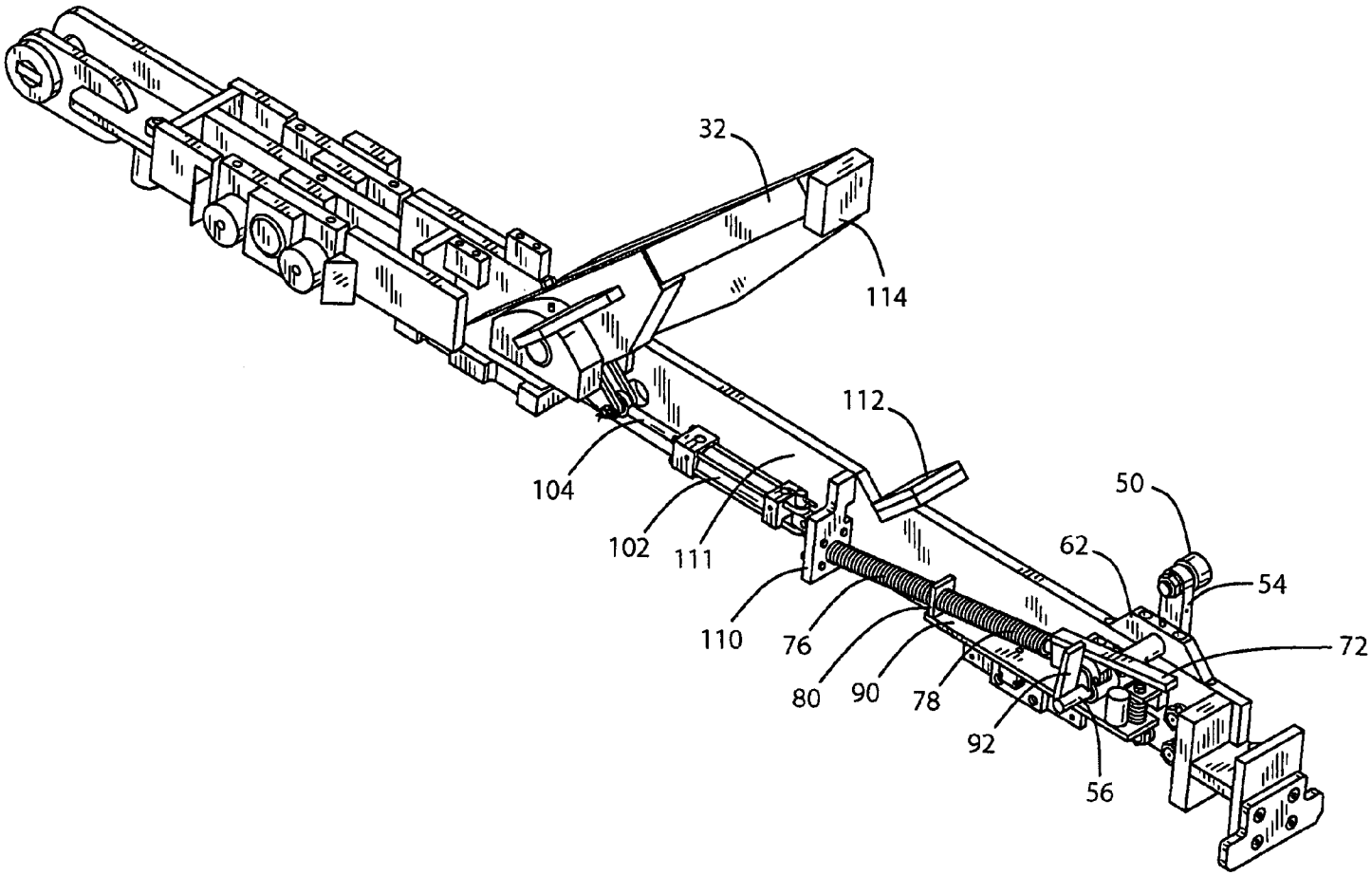
FIG. 6 shows the view of FIG. 5 as assembled.
Figure 7:
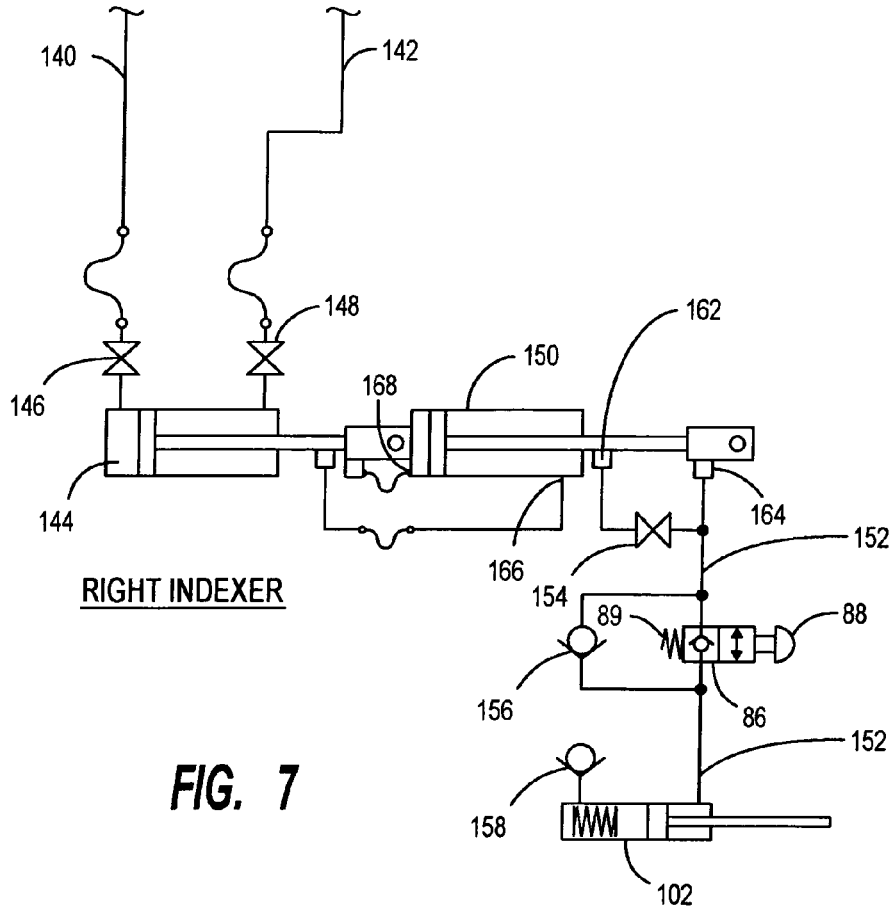
FIG. 7 shows a fragment of an indexer hydraulic schematic for operating an indexer in accordance with the invention.

As seen in the FIGS. 3-7, the bogey frame detection and dog-operating system of the invention includes a follower wheel 50 attached to a shaft 52 which, in turn, is mounted in a lever or crank arm 54, which is fixed to rotate an operating rod or shaft 56. A spacer sleeve member is provided at 58. The shaft 56 is, in turn, supported and mounted to rotate in sleeve 60 and openings in spaced parallel support gusset members 62 and 64, which are mounted on a carriage platform member 66 (FIG. 4). A combination spring-mounting rod 68 and pusher device 70 with extension 72 is provided, and is attached via an operating arm 74 fixed using a clevis-type mount to rotate with operating shaft 56. The rod 68 is adapted to carry a pair of compression springs 76 and 78, which are carried and maintained on either side of a deflection plate 80 having an opening 82 through which a free end of rod 68 is mounted. A washer 84 is fixed to the free end of rod 68 to retain the spring 76. A normally closed, spring-biased valve device 86 (see FIG. 7) is mounted in fixed relation to the carriage frame and is equipped with a resilient depressible operating pushbutton as at 88 which operates against an internal spring 89 (FIG. 7). Deflection plate 76 is fixed to a resilient flexing member 90, the underside of which is utilized to operate the pushbutton 88 of valve 86. A hold-down plate or "flag" lever 92 is also fixed to operating rod 56 and a return or release spring 94 for flag lever 92 is provided mounted in a hollow cylinder 96 fixed to the member 90.

A further counter-balance spring for counter-balancing the member 90 is shown at 98 and is mounted between an end of member 90 and a flange member 100 fixed to gusset 64 to counter-balance the major portion of the member 90 and associated parts, which are offset with respect to shaft 56.

The dog 32 is operated to be raised and lowered by a cylinder 102 having a rod 104 mounted between a clevis 96 attached to the dog 32 as by rod eye 108 and a heavy retaining gusset member 110 fixed to the carriage frame member 111. A stop 112 is provided to address and receive the pusher face 114 of the dog 32 when it is in the down or dropped position as shown in FIG. 4.

The fully rearward or return position of an indexer of the invention is shown best in the fragmentary perspective view of FIG. 4 in which dogs and followers both are in a hold-down mode. As seen in the FIG. 1, the guideway is further provided with a fixed heavy vertical gusset member 120 on which is mounted a hold-down roller 122 which is designed to rotate flag member 92 and hold it down at the end of a return stroke of the indexer. A further fixed heavy gusset member 124 is provided spaced from member 120 and carries a knock-down plate 126 fixed thereto. The knock-down plate further carries a proximity sensor 126 which senses the proximity of a fixed member 128 when the indexer is fully retracted. Detection of the member 128 by the proximity switch disables raising of the dog 32. In this position, as shown in FIG. 4, by operation of flag member 92, follower roller 50 is held in a down position in the opposite direction of that which occurs upon encountering a bogey frame side member when the indexer is advanced. Thus, valve 86 remains closed.

FIG. 6 depicts the parts of the exploded view of FIG. 5 in an assembled condition with the dog in the raised position and the follower wheel 50 and arm 54 also in the fully upright position. This configuration would occur as the carriage begins its retraction part of the cycle and the follower 50 comes out from under a bogey frame, but the dog 32 has not yet dropped or been pushed down.

FIG. 7 depicts a fragmentary schematic view of a portion of a hydraulic system utilized to operate an indexer in accordance with the present invention. The view includes a pair of hydraulic lines 140 and 142 connected to a carriage-moving cylinder 144 through respective solenoid valves 146 and 148. A second, serially connected carriage-moving cylinder is shown at 150 and additional serially connected cylinders for moving the carriage back and forth are not illustrated. A typical system will have four serially connected cylinders which add up to a total stroke for the left or right indexer of about 65 feet. This is sufficient distance to accommodate any normal inter-bogey frame interval. A by-pass hydraulic line is shown at 152 which is connected by a hydraulic valve 86 to operate dog cylinder 102. An additional solenoid valve is shown at 154 and check valves are depicted at 156 and 158.

Figure 8:
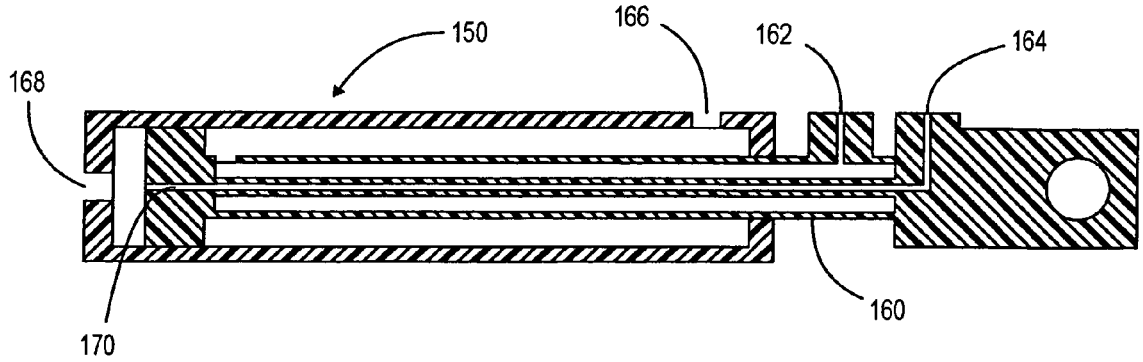
FIG. 8 is a simplified sectional view of a typical indexer cylinder in accordance with the invention.

A simplified sectional view of a typical indexer cylinder as at 150 is shown in FIG. 8 and includes a rod 160 having hydraulic connections at 162 and 164 and cylinder connections at 166 and 168. An internal by-pass line shown at 170, which provides fluid to extend the next cylinder, as shown in FIG. 7, and also fluid to retract the dog cylinder 102 and thereby raise the dog 32. Adequate under and over pressure protection is provided in the hydraulic system in a well known manner and the operational description assumes pressures and volumes within operating limits.

In operation, the left and right indexer systems coordinate the operation of the carriages 26 and 28 and the respective dogs 30 and 32 to operate in unison against a bogey frame. Thus, the operation of the system starts with indexers fully retracted with the dogs down and the sensing follower wheels in a locked down position as shown in the fragmentary view of FIG. 4. Owing to the amount of fluid which must be pumped to operate the system in the hunting mode, i.e., looking for a bogey frame to push, although both left and right indexers are activated, normally one will lead moving its carriage forward. Using the illustrated indexer example of the detailed embodiment will proceed until the follower 50 encounters the underside of a bogey frame side member and crank arm member 54 is pivoted to the left, as shown in FIGS. 2 and 3. Rotation of the follower crank arm as at 54 rotates the operating rod 56 in a counterclockwise direction based on FIGS. 2, 3 and 6, which pivots arm 74 and causes the pusher 70 and rod 68 to be displaced to the left thereby compressing spring 78 and releasing the compression on spring 76. Spring 78 thus pushes against plate 80 which, in turn, causes a downward flexure of member 90 depressing pushbutton valve operator 88 eventually with sufficient force to overcome the biasing of spring 89 and open the valve 86 as shown best in the fragmentary hydraulic schematic of FIG. 7.

The depression of pushbutton 88 is resisted by and must overcome the resistance of spring 89 and, nominally, about 100 pounds force is necessary to open valve 86 and maintain it in the open position. The opening of valve 86 allows hydraulic fluid to flow to and retract cylinder 102 which, in turn, causes the connected dog 32 to be raised into pushing position. After the first raised dog is in position against the corresponding bogey frame side member, the other indexer of the pair will perform the same sequence until both indexer dogs are in pushing position against the corresponding bogey frame side members. Further extension of the serially-connected carriage-moving cylinders will propel the bogey frame and connected car or cars along the tracks as desired. By using the balanced force of both right and left indexers against a bogey frame, a total force of 40 tons or more is available to advance the cars.

At the end of the total stroke or when it is desired to reverse the system, the serially-connected carriage-moving cylinders are caused to retract which, in turn, causes the follower wheel as at 50 to move out from under the bogey frame member 16 and thereby resume its upright position releasing the deflection on member 90 as aided by counter-balance spring 98, thereby releasing pushbutton 88 and closing valve 86. This enables the corresponding cylinder 102 to extend and allows the dogs as at 32 to drop. When the system is fully retracted, it resumes the initial position as previously described. The system can then be re-extended to encounter the next desired bogey frame. Of course, the system may be stopped at any time when a car of interest is properly positioned for loading or unloading.

While the above-described detailed embodiment describes a railcar indexer system which operates to move the cars in a single direction, it will be appreciated that each carriage could also carry a pair of oppositely disposed dogs in a well known manner to achieve a reversing system using the wheel truck bogey frame side member detecting system of the present invention. A system could also be built to be operated in the manner of a progressor, also in a well known manner, which would be familiar to those skilled in the art.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A railcar indexing system having carriage-mounted mechanical bogey frame detecting and dog operating systems comprising:

(a) a pair of dog carriages mounted for operation in spaced trackside guideways, each dog carriage including a pusher dog mounted on said carriage, each dog having an associated hydraulic dog cylinder for operating the dog;

(b) a bogey frame detecting system mounted on each of said dog carriages for use in controlling the operation of each of said dogs and further comprising, (1) detecting assembly including a crank arm-mounted follower positioned to be deflected by the underside of an encountered bogey frame, (2) a spring-biased, normally closed hydraulic valve device connected to control each hydraulic dog cylinder for controlling raising of a connected dog, wherein the opening of said valve is determined by a deflection of said follower in a first direction, (3) a resilient linkage assembly between said follower and said valve for transmitting sufficient force to open said valve.

2. A railcar indexing system as in claim 1 further comprising a system to lock down said followers when the indexing system is in a fully retracted position.

3. A railcar indexing system as in claim 1 wherein said resilient linkage assembly between said follower and said valve further comprises a spring-operated flexible valve opening member which presses on a pushbutton overcoming an internal valve spring to open said normally closed hydraulic valve.

4. A railcar indexing system as in claim 3 wherein said resilient linkage assembly further comprises:

(a) an operating shaft connected to be rotated in a first direction by deflection of said follower in a first direction upon encountering a bogey frame member;

(b) a pair of springs disposed in either side of a deflection plate which is fixed to said valve opening member near one end thereof; and (c) a spring carrying and pusher member mounted through an opening in said deflection plate and carrying said pair of springs, said member further having a fixed end mounted to move with rotation of said operating shaft in a manner which causes compression of one of said springs against one side of said deflection plate depending on the direction of rotation of said operating shaft to flex said valve opening member to open or release said valve.

5. A railcar indexing system as in claim 4 wherein said deflection plate and associated springs and spring carrying and pusher member are offset from said operating shaft and, further comprising a counter-balance spring positioned to operate against a fixed member and counter-balance said offset.

6. A railcar indexing system as in claim 5 wherein said system to lock down said followers when said indexer is fully retracted comprises a stationary deflection and deflectable flag member fixed to rotate said operating shaft in a second direction, opposite to said first direction, when said indexer is retracted thereby causing said follower to be lowered in a direction opposite the detecting direction.

* * * * *